United States Patent [19]

Joy

[11] 4,229,313

[45] Oct. 21, 1980

[54] ALKALI METAL HYPOCHLORITE BLEACHING AND CLEANING COMPOSITIONS THICKENED WITH BRANCH CHAIN AMINE OXIDES

[75] Inventor: David R. Joy, Middlesbrough, England

[73] Assignee: Imperial Chemical Industries Limited, London, England

[21] Appl. No.: 932,935

[22] Filed: Aug. 11, 1978

[30] Foreign Application Priority Data

Sep. 2, 1977 [GB] United Kingdom ..... 36713/77

[51] Int. Cl.[2] ..... C11D 7/54; C11D 3/30; C11D 9/42

[52] U.S. Cl. ..... 252/98; 252/102; 252/117; 252/547; 252/DIG. 14

[58] Field of Search ..... 252/95, 96, 98, 99, 252/102, 105, 528, 547

[56] References Cited

U.S. PATENT DOCUMENTS

| | | | |
|---|---|---|---|
| 3,336,387 | 8/1967 | Finch et al. | 260/583 |
| 3,388,069 | 6/1968 | Lindner et al. | 252/99 |
| 3,402,128 | 9/1968 | Puchta et al. | 252/99 |
| 3,684,722 | 8/1972 | Hynam et al. | 252/98 |

FOREIGN PATENT DOCUMENTS

| | | | |
|---|---|---|---|
| 1466560 | 3/1977 | United Kingdom | 252/102 |

*Primary Examiner*—P. E. Willis, Jr.

*Attorney, Agent, or Firm*—Cushman, Darby & Cushman

[57] ABSTRACT

A cleaning or bleaching composition comprises water, an alkali metal hypochlorite and an amine oxide comprising a R—CH(R')—$CH_2$—group.

13 Claims, No Drawings

ALKALI METAL HYPOCHLORITE BLEACHING AND CLEANING COMPOSITIONS THICKENED WITH BRANCH CHAIN AMINE OXIDES

The present invention relates to a bleaching and cleaning composition containing a hypochlorite.

Aqueous solutions of an alkali metal hypochlorite are widely used in the cleaning and bleaching of fabrics and for general disinfectant purposes. The basic aqueous solution has the viscosity of water and it has been suggested e.g. in U.K. Pat. No. 1,329,086 that the efficiency of such solutions may be increased by making them more viscous so that they adhere longer to inclined surfaces and do not drain away before performing their bleaching/disinfecting function. The thickening agent recommended in U.K. Pat. No. 1,329,086 is a combination of an alkali metal salt of a $C_8$ to $C_{18}$ fully saturated fatty acid and a hypochlorite-soluble surface active agent, the latter being exemplified by an amine oxide containing a $C_8$ to $C_{18}$ alkyl group. The amine oxides described in the patent are those commercially available which are derived from naturally occurring $C_8$ to $C_{18}$ fatty acids e.g. coconut acids, lauric acid and myristic acid. We have now found that if the amine oxide is derived from a synthetic fatty acid of certain structure the viscosity of the hypochlorite solution shows a greater increase than with the conventional amine oxides, with or without the presence of the alkali metal salt of the fatty acid.

According to the invention therefore, a cleaning or bleaching composition comprises water, an alkali metal hypochlorite and an amine oxide which contains a

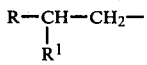

group, where R is a straight chain $C_5$ to $C_{17}$ alkyl group, $R^1$ is a $C_1$ to $C_3$ alkyl group preferably a methyl group and the group

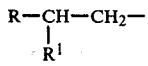

contains 8 to 20 carbon atoms.

The amine oxide in toto has the formula

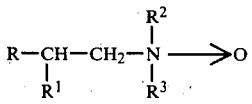

where $R^2$ and $R^3$, which may be the same or different are each alkyl groups containing up to six carbon atoms and are preferably methyl groups. The amine oxide may be produced by conventional means from the corresponding tertiary amine and the latter in turn may conveniently be obtained by reacting a secondary amine $R^2R^3NH$ with an alcohol,

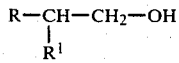

or aldehyde,

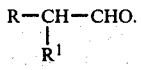

The alcohol or aldehyde may be produced by carbonylating or hydroformylating an olefine, preferably a straight chain alpha-olefine, when a product is obtained which comprises a mixture of the desired branched chain aldehyde or alcohol and the corresponding straight chain aldehyde or alcohol of same carbon number. Although the branched and straight chain isomers may be separated we have found that it is technically satisfactory and economically advantageous to use the mixture in the preparation of the tertiary amine and amine oxide so that a mixture of amine oxides is obtained comprising

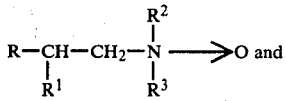

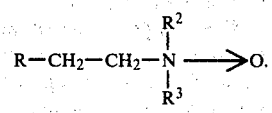

Such a mixture may contain 40 to 60 wt% straight chain amine oxide and 60 to 40 wt% branched c ain amine oxide. (References hereinafter to $C_{13}$, and $C_{15}$ etc. amine oxides ignore the contribution of the groups $R^2$ and $R^3$ to the total number of carbon atoms in the amine oxide. Thus, for example, a $C_{13}$ amine oxide refers to an oxide in which the group

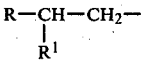

or the group $R—CH_2—CH_2—$ contains a total of 13 carbon atoms).

We have also found that an effective product may be obtained if the aldehyde or alcohol is derived from a mixture of olefines so that the ensuing amine oxide comprises a mixture of compounds of different carbon number and of isomers containing straight chain and 2-alkyl branched chain alkyl groups. In particular we have made such a mixture comprising 65 to 75 wt% $C_{13}$ and 35 to 25 wt % $C_{15}$ amine oxides with approximately 50 wt% straight chain and 50 wt% 2-alkyl branched chain where the 2-alkyl group is predominantly methyl.

The alkali metal hypochlorite may be a lithium, potassium or sodium hypochlorite, preferably the latter. It is preferred to use hypochlorite which is relatively freshly prepared. The available chlorine level in hypochlorite gradually falls away with time elapsed after its preparation and so it is preferred to use hypochlorite which has been prepared immediately or shortly before use. The Applicants have found that hypochlorite used within two days of its preparation is suitable for use in the preparation of the composition of the invention. However, it is likely that the level of available chlorine in hypochlorite which is much more than a week old will be beginning to fall away unacceptably. The alkali metal hypochlorite generally comprises 1 to 20% by weight of the composition (measured as available chlorine) and the amine oxide 0.1 to 5 wt%.

The cleaning or bleaching composition may also contain components other than those mentioned above. For example, the composition may contain an auxiliary thickening agent such as an alkali metal salt of a $C_8$ to $C_{20}$ fatty acid e.g. sodium or potassium laurate, oleate, stearate or palmitate suitably in a concentration of 0.3 to 3.0% by weight of the composition prior to the addition of the hypochlorite.

The composition may also include a caustic alkali e.g. sodium hydroxide or potassium hydroxide in an amount preferably in the range 0.5 to 2% by weight of the composition. A perfume may also be present in the composition.

The invention will now be further described with reference to the following Examples.

EXAMPLES

(a) Preparation of the Amine oxide

A mixture of tertiary amines was used comprising

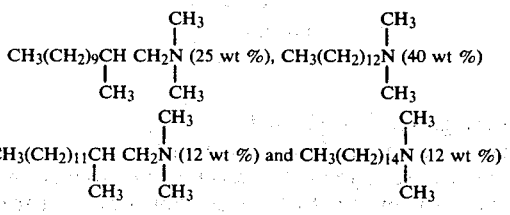

The balance of the mixture was made up of other branched $C_{13}$ and $C_{15}$ tertiary amines (10 wt %) and $C_{11}$ and $C_{17}$ amines. 82.6 grams of the mixture and 0.8 gram of the disodium salt of ethylene diamine tetraacetic acid were heated to 90° C. 47 grams of 35 wt % aqueous hydrogen peroxide were than added over a period of 60 minutes together with sufficient water to keep the mixture mobile. When the hydrogen peroxide addition was complete more water was added over a period of 20 minutes to a total of 163 grams. The mixture was then stirred at 90° C. for further 25 minutes. Final analysis of the product revealed a free amine oxide content of 0.7 wt% (as molecular weight 237) and an amine content of 28.3 wt%. (as a molecular weight 253).

Batches (100 g) of formulations were made up as follows using the amine oxide prepared as described above and designated "Synprolam 35DMO". The amine oxide and a soap (sodium laurate) were dissolved in water and the solution was then mixed with freshly prepared sodium hypochlorite containing 14 to 15% available chlorine. The viscosity of the resultant mixture was measured one hour after preparation in an Ostwald viscometer.

For comparison, similar mixtures were prepared using two different amine oxides viz "Ammonyx LO" which is a dodecyldimethylamine oxide and "Aromox DMMCDW" which is a $C_{12}$ to $C_{14}$ middlecut coconut alkyl dimethyl amine oxide. The compositions prepared and the results obtained are summarised in the following Table.

| COMPOSITION (wt %) | | | | VISCOSITY (cS) at 25° C. | | |
|---|---|---|---|---|---|---|
| Amine Oxide as 30% aqueous solution | Sodium Laurate | Water | Sodium Hypo-chlorite | Synprolam 35 DMO | Ammonyx LO | Aromox DMMCDW |
| 2.00 | 0.0 | 31.33 | 66.66 | 1.94 | 1.66 | |
| 3.00 | 0.0 | 30.33 | 66.66 | 2.30 | 1.70 | |
| 1.975 | 0.1361 | 31.22 | 66.66 | 16.7 | 3.08 | |
| 2.1583 | 0.1750 | 31.0 | 66.66 | 31.35 | 3.08 | 8.5 |
| 2.2167 | 0.1167 | 30.99 | 66.66 | 12.6 | 3.45 | 4.1 |
| 2.7667 | 0.1167 | 30.33 | 66.66 | 54.7 | 7.90 | 15.5 |
| 2.8833 | 0.2333 | 30.33 | 66.66 | 28.0 | 2.38 | 3.1 |

As can be seen, the viscosity of compositions according to the invention is consistently greater than those prepared using "Ammonyx LO" and "Aromox DMMCDW".

I claim:

1. A cleaning or bleaching composition comprising water, from 1 to 20 percent by weight of an alkali metal hypochlorite, measured as available chlorine, and from 0.1 to 5 percent by weight of an amine oxide component comprising a branched amine oxide which contains a

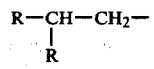

group, where R is a straight chain $C_5$ to $C_{17}$ alkyl group, $R^1$ is a $C_1$ to $C_3$ alkyl group and the group

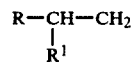

contains 8 to 20 carbon atoms, the amine oxide in toto having the formula:

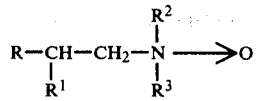

where $R^2$ and $R^3$, which may be the same or different, are each alkyl groups containing up to six carbon atoms.

2. A composition as claimed in claim 1 in which the amine oxide component comprises a mixture of branched and straight chain amine oxides.

3. A composition as claimed in claim 1 in which the amine oxide component comprises a mixture of 40 to 60 wt% straight chain amine oxide and 60 to 40% branched chain amine oxide.

4. A composition as claimed in claim 1 in which the amine oxide component comprises a mixture of amine oxides of formula

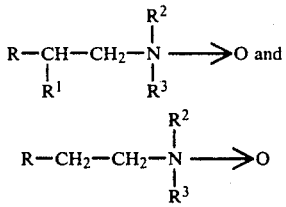

5. A composition as claimed in claim 1 in which the amine oxide component comprises a mixture of compounds of different carbon number and of isomers containing straight chain and 2-alkyl branched chain alkyl groups.

6. A composition as claimed in claim 5 in which the amine oxide mixture comprises 65 to 75% $C_{13}$ and 35 to 25 wt% $C_{15}$ amine oxides with approximately 50 wt% straight chain and 50 wt% 2-alkyl branched chain where the 2-alkyl group is predominantly methyl.

7. A composition as claimed in claim 1 in which the alkali metal hypochlorite is selected from lithium, potassium and sodium hypochlorite.

8. A composition as claimed in claim 1 in which the composition contains up to about 0.23% by weight of the composition of an auxiliary thickening agent comprising an alkali metal salt of a $C_8$ to $C_{20}$ fatty acid.

9. A composition as claimed in claim 1 in which the composition contains from about 0.5 to about 2% by weight of the composition of a caustic alkali.

10. A composition as claimed in claim 1 in which $R^1$ is methyl.

11. A composition as claimed in claim 1 in which $R^2$ and $R^3$ are both methyl.

12. A cleaning or bleaching composition comprising:

(1) from 1 to 20 percent by weight of the composition of an alkali metal hypochlorite, measured as available chlorine, (2) from 0.1 to 5 percent by weight of a mixture of 40 to 60 weight percent straight chain amine oxide and 60 to 40 weight percent branched chain amine oxide, the amine oxide containing a

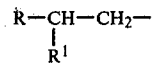

group, where R is a straight chain $C_5$ to $C_{17}$ alkyl group and $R^1$ is a $C_1$ to $C_3$ alkyl group, and the group

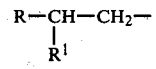

contains 8 to 20 carbon atoms, the amine oxide in toto having the formula:

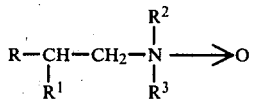

where $R^2$ and $R^3$, which may be the same or different, are each alkyl groups containing up to 6 carbon atoms, and (3) balance water.

13. A composition as claimed in claim 12 in which $R^1$, $R^2$ and $R^3$ of the branched chain amine oxide all are methyl.

* * * * *